US007333317B2

(12) United States Patent
Benysh et al.

(10) Patent No.: US 7,333,317 B2
(45) Date of Patent: Feb. 19, 2008

(54) PORTABLE IONIZER

(75) Inventors: Susan Ann Hodapp Benysh, Rochester, MN (US); Edward Charles Gillard, Mantorville, MN (US); Don Alan Gilliland, Rochester, MN (US); Dennis Elmer Maloney, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 202 days.

(21) Appl. No.: 11/211,957

(22) Filed: Aug. 25, 2005

(65) Prior Publication Data

US 2007/0047168 A1 Mar. 1, 2007

(51) Int. Cl.
*H05H 1/00* (2006.01)
*B08B 5/00* (2006.01)

(52) U.S. Cl. ..... 361/231; 134/1

(58) Field of Classification Search ..... 361/213, 361/225, 231; 134/1, 37
See application file for complete search history.

(56) References Cited

U.S. PATENT DOCUMENTS

| | | | | |
|---|---|---|---|---|
| 5,883,934 | A * | 3/1999 | Umeda | 378/64 |
| 6,118,645 | A * | 9/2000 | Partridge | 361/231 |
| 6,313,635 | B1 * | 11/2001 | Noll | 324/395 |
| 6,919,053 | B2 * | 7/2005 | Joannou | 422/186 |
| 2003/0137794 | A1 * | 7/2003 | Izumi et al. | 361/231 |
| 2004/0118428 | A1 * | 6/2004 | Stelcher et al. | 134/1 |
| 2007/0006478 | A1 * | 1/2007 | Kotsuji | 34/96 |

* cited by examiner

*Primary Examiner*—Michael Sherry
*Assistant Examiner*—Boris Benenson
(74) *Attorney, Agent, or Firm*—Joan Pennington

(57) ABSTRACT

A portable ionizer is arranged for generating ionized air in an area of a user's fingers. The portable ionizer includes a battery-powered oscillator coupled via a high voltage conversion circuit to a positive electrode and a negative electrode for generating positive and negative ions. A fan positioned near the positive and negative electrodes is arranged providing a positive and negative ion flow path to the area of the user's fingers.

15 Claims, 3 Drawing Sheets

PORTABLE IONIZER

FIELD OF THE INVENTION

The present invention relates generally to ionizers, and more particularly, relates to a portable ionizer arranged for generating ionized air in an area near a user's fingers.

DESCRIPTION OF THE RELATED ART

Typically there is a need for reducing charge and lowering electrostatic discharge (ESD) potentials in and around areas of assembly and manufacturing of sensitive electronic equipment, such as, data processing equipment and information technology equipment (ITE).

Also when assembling information technology equipment (ITE) within an enclosure or rack, for example, a need exists to neutralize charge and to lower the potential for charge transfer between non-neutralized parts.

Known solutions include the use of a room ionizer, or a bench top ionizer that remains fixed by power cord to a bench. The room ionizer and the bench top ionizer often are ineffective for neutralizing or reducing charge, or for lowering ESD discharge potentials in an area near a user's fingers, during assembly and manufacturing of electronic equipment.

A need exists for effective mechanism for use during assembly and manufacturing of sensitive electronic for neutralizing or reducing charge, and for lowering ESD discharge potentials in an area near a user's fingers equipment. It is desirable to provide such mechanism that generates ionized air in an area near a user's fingers.

SUMMARY OF THE INVENTION

A principal aspect of the present invention is to provide a portable ionizer arranged for generating ionized air in an area near a user's fingers. Other important aspects of the present invention are to provide such portable ionizer substantially without negative effect and that overcome many of the disadvantages of prior art arrangements.

In brief, a portable ionizer is arranged for generating ionized air in an area of a user's fingers. The portable ionizer includes a battery-powered oscillator coupled via a high voltage conversion circuit to a positive electrode and a negative electrode for generating positive and negative ions. A fan positioned near the positive and negative electrodes is arranged providing a positive and negative ion flow path to the area of the user's fingers.

In accordance with features of the invention, the portable ionizer includes a housing containing a battery supply, the battery-powered oscillator, and the high voltage conversion circuit. A handle provided with the housing enables the user to carry the portable ionizer with the positive and negative ion flow path provided in the area of the user's fingers.

In accordance with features of the invention, the handle can include one or more coiled straps that hold the portable ionizer onto the user's arm. The handle can include a selected one of a clip, such as a belt clip, or a bag, together with tubing for providing the positive and negative ion flow path to the area of the user's fingers.

In accordance with features of the invention, the portable ionizer effectively provides a localized stream of ions with less dispersal than a desktop ionizer, particularly for use during assembly and manufacturing of sensitive electronic.

In accordance with features of the invention, the portable ionizer includes a wrist strap connection on the housing to neutralize the user with respect to ground.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

In accordance with features of the preferred embodiment, a portable ionizer is provided that solves a portability problem to flood the area of possible charged items, such as mainly plastic or ungrounded metallic parts, for assembly, and manufacturing of sensitive electronic equipment, such as, data processing equipment and information technology equipment (ITE) or at the customer's location to lower the potential for charge transfer between non-neutralized parts, for example, in the assembly and operation of ITE in a data center or computer room. The portable ionizer advantageously includes an additional wrist strap connection that serves to equalize operator to ground.

Figure 1:
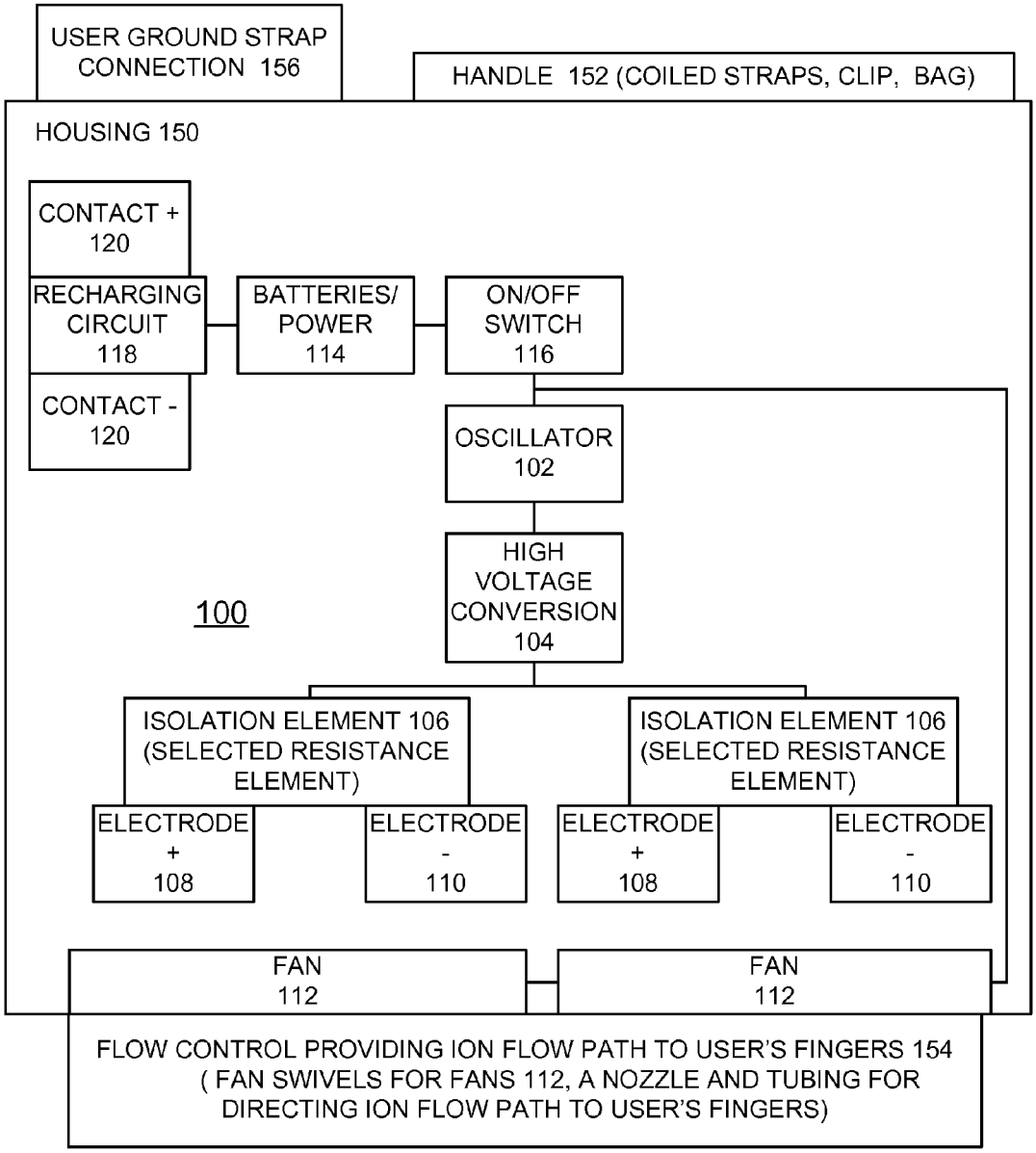
FIG. 1 is schematic diagram illustrating an exemplary portable ionizer in accordance with the preferred embodiment.

Having reference now to the drawings, in FIG. 1, there is shown an exemplary portable ionizer generally designated by the reference character 100 in accordance with the preferred embodiment. Portable ionizer 100 includes an oscillator 102 coupled to a high voltage conversion circuit 104. An isolator or isolation element 106 is coupled between a first and a second pair of a positive electrode 108 and a negative electrode 110 or ionizing pins 108, 110.

Each of the isolation elements 106 is implemented, for example, with a selected resistance element. The high voltage circuit 104 coupled to the oscillator 102 includes, for example, a transformer and boost circuit that drives the ionizing pins 108, 110 via the isolation elements 106. The oscillator 102 and high voltage circuit 104 are contained and drive the ionizing pins 108, 110 to a high voltage producing both positive and negative ions.

In accordance with features of the preferred embodiment, the positive and negative ions, when distributed over an area by a pair of fans 112 that are positioned for blowing positive and negative ions towards the hands and user's fingers, neutralize the charge on nearby objects, providing protection for handling or assembling sensitive electronic assemblies.

Portable ionizer 100 includes a battery compartment for a plurality of batteries 114, for example, typically including multiple Alkaline or rechargeable batteries. An on/off switch 116, such as arm switch 116 couples the batteries to the oscillator 102. The portable ionizer unit 100 includes a cradle recharging circuit 118 including a pair of contacts 120 for recharging of rechargeable batteries 114.

A housing 150 containing the batteries 114, oscillator 102 and high voltage circuit 104 includes a handle 152 enabling the user to conveniently and easily carry the portable ionizer 100. The handle 152 includes, for example, a clip, such as a belt clip, a bag for containing the housing 150, or one or multiple coiled straps, such as illustrated and described with respect to FIGS. 2 and 3.

A flow control 154 is provided with the housing for providing a positive and negative ion flow path to the area of the user's fingers. The flow control 154 can include fan swivels for positioning the fans 112, a nozzle and tubing for directing the positive and negative ion flow from the fans 112 to the area of the user's fingers. The flow control tubing 154 is used, for example, when a bag or a belt clip implements the handle 152 for the portable ionizer 100. A user ground strap connection 156 is provided, for example, at the back of the portable ionizer 100 to neutralize the operator with respect to ground.

Figure 2:
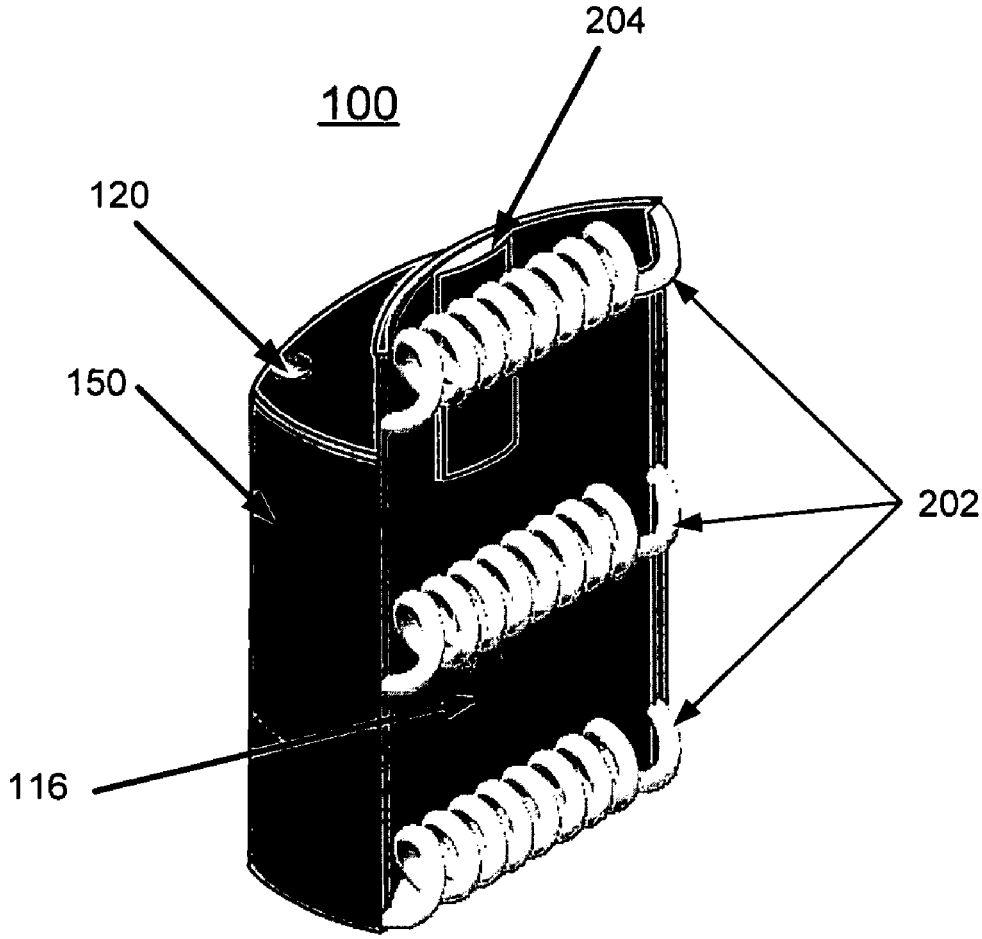
FIG. 2 is a perspective view illustrating an exemplary portable ionizer of FIG. 1 in accordance with the preferred embodiment.
Figure 3:
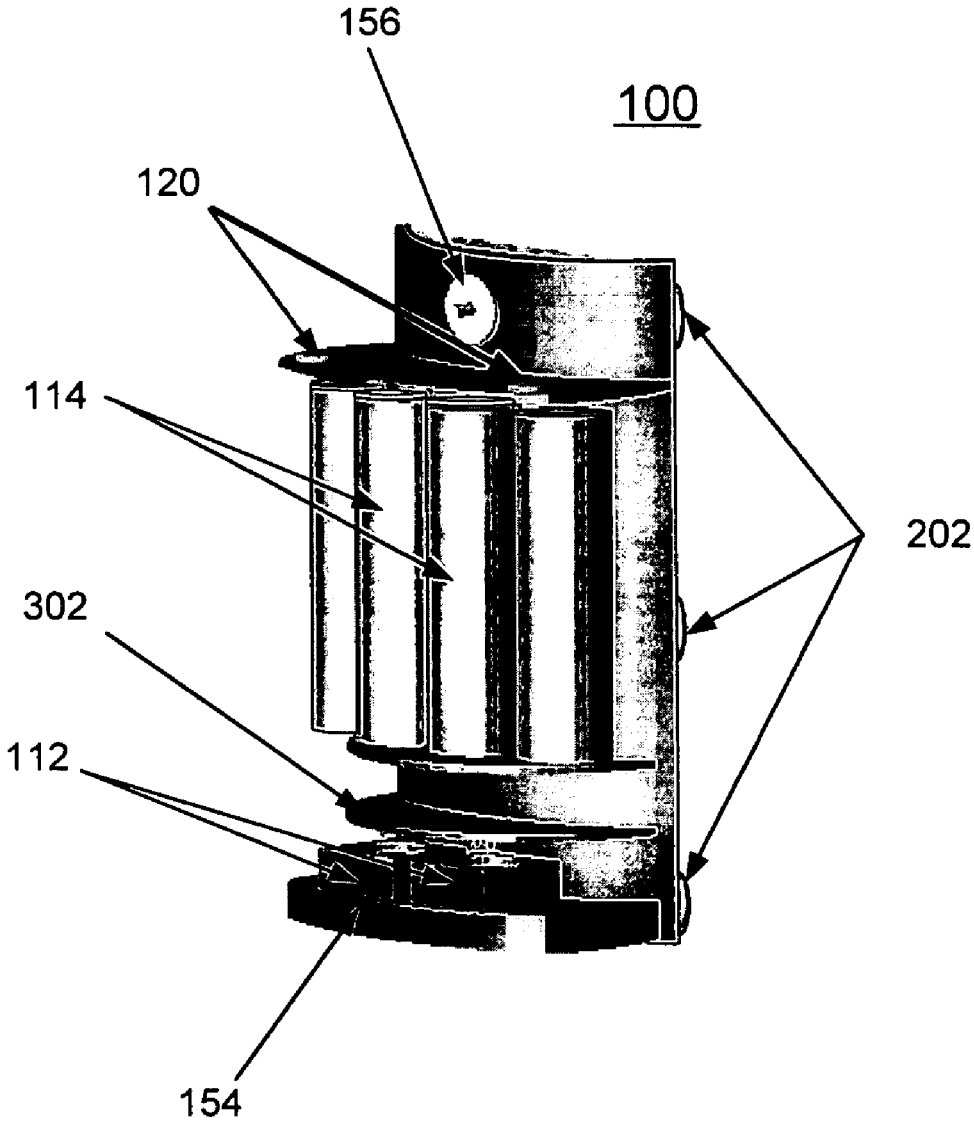
FIG. 3 is a perspective view illustrating interior details of the portable ionizer of FIG. 2 in accordance with the preferred embodiment.

Referring to FIGS. 2 and 3, there is shown an exemplary portable ionizer unit 100 arranged to strap onto a user's arm. In FIG. 2, portable ionizer unit 100 is shown with a plurality of coiled straps 202 mounted onto a generally flat face of the housing 150. FIG. 3 illustrates interior details of the portable ionizer 100 of FIG. 2 in accordance with the preferred embodiment.

It should be understood that the portable ionizer unit 100 can have various different arrangements, and is not limited to the illustrated exemplary arrangement shown in FIGS. 2 and 3.

As best shown in FIG. 2, the handle 152 is implemented with the plurality of coiled straps 202 that hold the portable ionizer unit 100 onto the arm of the operator and easily provides a comfortable fit to various arm sizes, without requiring adjustment.

An electrically conductive bar 204 is mounted for contact engagement with the arm of the operator and is electrically connected to the wrist strap connection 156 that is shown in FIG. 3. The portable ionizer unit 100 powers on with the switch 116 located generally centrally within the cuff side of housing 150.

As shown in FIG. 3, the portable ionizer unit 100 is sized, for example, to accommodate four AA size batteries 116, which provides adequate power for typical use of the portable ionizer 100. A circuit board 302 carries the ion producing pins 108, 110 near the fans 112. The two fans 112 pull the air from the battery area past the ion producing pins 108, 110 towards the area around the operator's fingers.

In accordance with features of the preferred embodiment, the portable ionizer unit 100 provides a more localized stream of ions with less dispersal than a conventional desktop ionizer, and is adapted for convenient and comfortable use.

While the present invention has been described with reference to the details of the embodiments of the invention shown in the drawing, these details are not intended to limit the scope of the invention as claimed in the appended claims.

What is claimed is:

1. A portable ionizer for generating ionized air in an area of a user's fingers, the area including a small, localized area near the user's fingers, said portable ionizer comprising:

a battery-powered oscillator;

a high voltage conversion circuit coupled to said battery-powered oscillator;

a positive electrode and a negative electrode coupled to said high voltage conversion circuit for generating positive and negative ions;

an isolation element coupled between said positive electrode and said negative electrode; said isolation element coupling said high voltage conversion circuit to said positive electrode and said negative electrode;

one or more coiled straps for holding the portable ionized on user's arm;

a fan positioned near the positive and negative electrodes for providing a positive and negative ion flow path to the area of the user's fingers.

2. A portable ionizer as recited in claim 1 further includes a housing containing a battery supply.

3. A portable ionizer as recited in claim 2 wherein said housing contains said battery-powered oscillator, and said high voltage conversion circuit.

4. A portable ionizer as recited in claim 2 further includes a handle provided with said housing to enable the user to carry the portable ionizer with the positive and negative ion flow path provided in the area of the user's fingers.

5. A portable ionizer as recited in claim 4 wherein said handle includes a clip.

6. A portable ionizer as recited in claim 1 includes a flow control for providing the positive and negative ion flow path to the area of the user's fingers.

7. A portable ionizer as recited in claim 1 further includes a ground strap connection to neutralize the user with respect to ground.

8. A portable ionizer as recited in claim 6 wherein said flow control includes a swivel carrying and positioning said fan.

9. A portable ionizer as recited in claim 1 further includes a second pair of positive and negative electrodes, said second pair of positive and negative electrodes coupled to said high voltage conversion circuit for generating positive and negative ions.

10. A portable ionizer as recited in claim 9 further includes a second fan positioned near said second pair of positive and negative electrodes further providing said positive and negative ion flow path to the area of the user's fingers.

11. A portable ionizer as recited in claim 10 further includes an isolation element coupled between said second pair of positive and negative electrodes and said high voltage conversion circuit; said isolation element including a selected resistance element.

12. A portable ionizer as recited in claim 1 wherein said isolation element includes a selected resistance element.

13. A portable ionizer for generating ionized air in an area of a user's fingers, the area including a small, localized area near the user's finger, said portable ionizer comprising:

a battery-powered oscillator;

a high voltage conversion circuit coupled to said battery-powered oscillator;

a first positive electrode and negative electrode pair;

a second positive electrode and negative electrode pair;

a first isolation element coupled between said first positive electrode and negative electrode pair;

a second isolation element coupled between said second positive electrode and negative electrode pair;

said first positive electrode and negative electrode pair coupled to said high voltage conversion circuit by said first isolation element and said second positive electrode and negative electrode pair coupled to said high voltage conversion circuit by said second isolation element for generating positive and negative ions;

one or more coiled straps for holding the portable ionized on user's arm;

at least one fan positioned near said first and said second positive electrode and negative electrode pairs for providing a positive and negative ion flow path to the area of the user's fingers.

14. A portable ionizer as recited in claim 13 further includes a housing containing said battery-powered oscillator, and said high voltage conversion circuit.

15. A portable ionizer as recited in claim 13 further includes a handle provided with a housing to enable the user to carry the portable ionizer with the positive and negative ion flow path provided in the area of the user's fingers.

* * * * *